United States Patent [19]

Bunyard

[11] 4,167,897

[45] Sep. 18, 1979

[54] ROTARY ACTUATORS

[76] Inventor: Alan D. Bunyard, Burrell Rd., Haywards Heath, Sussex RH16 1TN, England

[21] Appl. No.: 697,132

[22] Filed: Jun. 17, 1976

[30] Foreign Application Priority Data

Jun. 19, 1975 [GB] United Kingdom ..... 26084/75

[51] Int. Cl.[2] ..... F01B 7/02

[52] U.S. Cl. ..... 92/69 R; 92/31; 92/136; 92/138

[58] Field of Search ..... 92/69 R, 50, 75, 73, 92/150, 136, 138, 31, 33; 251/58

[56] References Cited

U.S. PATENT DOCUMENTS

| | | | |
|---|---|---|---|
| 3,246,581 | 4/1966 | Carr | 92/138 |
| 3,505,934 | 4/1970 | De Biasse | 92/212 |
| 3,537,358 | 11/1970 | Bunyard | 92/136 |
| 3,672,260 | 6/1972 | Gachot | 92/69 R |
| 3,906,923 | 9/1975 | Harker | 92/212 |
| 3,982,725 | 9/1976 | Clark | 92/69 R |

FOREIGN PATENT DOCUMENTS

| | | | |
|---|---|---|---|
| 1901740 | 8/1970 | United Kingdom | 92/136 |
| 1252634 | 7/1959 | France | 92/136 |

*Primary Examiner*—Abraham Hershkovitz
*Attorney, Agent, or Firm*—Irving M. Weiner; Pamela S. Burt; Melvin Yedlin

[57] ABSTRACT

A piston rack rotary actuator, devoid of guiding tubes or rods along which the pistons reciprocate, is provided with guide bearings which eliminate or at least reduce the incidence of the separating forces which otherwise act on the racks (particularly when the pistons are moved towards one another) to displace them towards the cylinder wall and which thereby otherwise cock the pistons in the cylinder and cause scoring of the cylinder wall.

1 Claim, 9 Drawing Figures

ROTARY ACTUATORS

This invention relates to rotary fluid pressure actuators.

A type of rotary fluid pressure actuator has been known for many years which comprises a cylinder with two pistons, each integral with a rack, the two racks engaging a pinion which extends transversely of the cylinder at the mid-length point of the cylinder. As the pistons move simultaneously either towards or away from one another under the influence of a fluid under super-atmospheric pressure, the pinion is moved angularly about its axis of rotation by said racks. The pistons are not guided on or supported by any rods during their reciprocating movements. Equal torque is said to be produced in each direction of angular movement of said pinion. This type of actuator has been described and illustrated in "Machine Design, Fluid Power" dated Sept. 19, 1968, to quote but one example.

The type of actuator described in the preceding paragraph will hereinafter be referred to as "a rotary actuator of the type described".

A rotary actuator of the type described (as defined above) has an inherent defect in that, in the case of each piston and its integral rack, that end of the piston in which the rack is formed tends to score the cylinder wall during operation of the actuator. The reason for this is very well-known, namely, that the teeth of the rack of each piston tend to ride up the pinion teeth with which they mesh by virtue of the fact that the shaft in which the pinion teeth are cut or to which the gear pinion(s) is or are secured is only free to rotate or move angularly and that the piston is only free to perform rectilinear movements. The separating force which causes the rack teeth to ride up the pinion teeth is known to be greater when the pistons are moved towards one another than it is when they are moved away from one another, and of course, the piston itself becomes scored as it scores the cylinder wall.

Naturally, a part of the available power is wasted in overcoming the friction developed as the rack-bearing end of each piston rubs along the cylinder wall. Moreover, if the scoring of the cylinder wall becomes sufficiently severe (as it does eventually), not only is there the danger of the O-ring or other seal carried by the full-diameter part of the piston failing to seal against the cylinder wall, but also there is the danger of the scored metal tearing the O-ring or other seal and eventually rendering it useless for its purpose.

The primary object of the present invention is to overcome these defects.

According to a first aspect, the present invention consists in a rotary actuator of the type described (as defined above) wherein, in the case of each piston, that part of the piston in which the rack is provided carries an element or elements which is or are made of an elastomeric or synthetic resin material having a low coefficient of friction and which is or are so placed as to be in contact with the adjacent portion of the cylinder wall at all times, whereby the separating forces are counteracted which are generated by movement of said pistons towards or away from one another and which tend to displace said part of each of said pistons towards the cylinder wall.

If one element is employed, said element will preferably be accommodated in and project radially from a channel formed in the curved periphery of said part of the piston, which periphery may have a curvature matching that of said adjacent portion of the cylinder wall.

If two or more elements are employed, each will preferably be accommodated in and project radially from an equal number of housing cavities or recesses which are formed in the curved periphery of said part of the piston, which periphery may have a curvature matching that of said adjacent portion of the cylinder wall.

Said channel, and said housing cavities or recesses, may extend or be aligned, respectively, circumferentially of said curved periphery or axially of said piston or along a part-helical path. One convenient arrangement which would provide a circumferential channel or channels would be to make said part of the piston in such a manner that a portion of its free end (viz. the end remote from the full-diameter part of the piston) is removably securable to the remainder of said part of the piston in which the rack is provided, the abutting faces being appropriately cut away to create a channel of a cross-sectional shape such as to enable one or more than one element to be positively held in said channel or channels.

According to a second aspect, the present invention consists in a rotary actuator of the type described (as defined above) wherein the cylinder carries an element or elements which is or are made of an elastomeric or synthetic resin material having a low coefficient of friction and which is or are so placed as to be in contact at all times with the curved outer periphery of that part of each piston in which said rack is provided.

Said element may extend circumferentially (viz. its median line will be contained in a diametral plane of said cylinder), or, in the case of two or more elements being carried by the cylinder, said elements may extend axially of the cylinder or in part-helical paths along said cylinder.

If the pinion output shaft of the actuator according to either of the first and second aspects of the present invention is provided with two sets of teeth, one set being spaced from the other set along the axis of the output shaft, said output shaft will preferably carry an annulus which (a) is made of an elastomeric or synthetic resin material having a low coefficient of friction; and (b) is of a diameter such as will contact a flat runway which is provided on said part of each of said pistons and which divides the rack teeth on each of said pistons into two spaced sets of teeth; whereby said annulus in contact with the opposed runways on the pistons will, during operation of the actuator, positively maintain contact between said elements or element and the metal parts or part concerned and will positively maintain correct meshing of the teeth of the racks and the pinion.

Alternatively, in the case where the pinion output shaft has a set of teeth which is uninterrupted axially of the shaft, said shaft will carry axially spaced annuli each of which (a) is made of an elastomeric or synthetic resin material having a low coefficient of friction; and (b) is of a diameter such as will contact one of two spaced flat runways which are provided on said part of each of said pistons;

whereby said annuli in contact with the opposed runways on the pistons will, during operation of the actuator, positively maintain contact between said element or elements and the metal part or parts concerned and will positively maintain correct meshing of the teeth of the racks and the pinion.

The present invention will now be more particularly described with reference to the accompanying drawings, in which.

DETAILED DESCRIPTION

Figure 1:
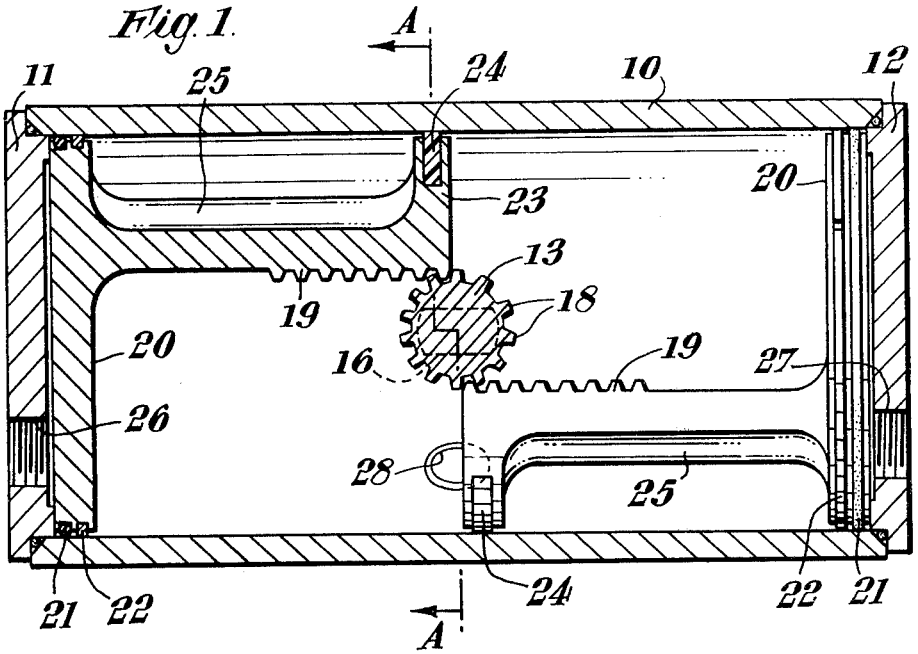
FIG. 1 represents, schematically, an axial section of a preferred embodiment of a rotary fluid pressure actuator according to the present invention.

Referring to the drawings, there is illustrated therein a rotary actuator of the type described (as defined above) which comprises a cylinder 10 whose open ends are closed by end caps 11, 12. An output shaft 13 extends transversely of the cylinder 10 in such a manner that its axis of rotation is contained by a diametral plane which is normal to the longitudinal axis of said cylinder and in such a manner that said axis of rotation extends through the mid-length point of said longitudinal axis. End portions 14, 15 of said shaft 13 are journalled in the cylinder 10, and said shaft 13 is also provided at one end thereof with a projecting boss 16 of non-circular cross-sectional shape and at the other end thereof with a recess 17 of square cross-sectional shape.

Said shaft 13 further includes teeth 18 which form a center gear, the teeth 18 on opposite sides of said center gear being in mesh with the teeth of two racks 19 which are integral with two pistons 20. The pistons 20 are of course of a circular configuration and size commensurate with those of the inside surface of the cylinder 10, and the periphery of each piston is so formed as to accommodate an O-ring seal 21 and a piston bearing 22 which is split to facilitate the fitting thereof to the piston. The racks 19, on the other hand, are constituted by axially extending members each of which is joined at one end thereof to the associated piston and each of which terminates at the other end thereof in a radially extending portion 23 which is so formed as to accommodate a guide bearing 24, each of said members incorporating at least one stiffening web 25 so as to strengthen the connection between the piston 20 and the associated portion 23.

The end caps 11, 12 are provided with inlet/exhaust ports 26, 27 and the cylinder 10 is provided with a centrally positioned inlet/exhaust port 28. These various ports are provided for the purpose of supplying a fluid under super-atmospheric pressure to the appropriate piston faces and exhausting used pressurised fluid from the other piston faces in order to obtain the required angular movement of the shaft 13 in known manner.

O-ring seals are provided, as illustrated, in other places in the usual way, namely, at the journals of the shaft 13 and between each end cap and the relevant end of the cylinder 10.

The boss 16 is provided to enable a human operator, equipped with an appropriate tool, to move the shaft 13 angularly as desired, for example, in the case of failure of the pressurised fluid line. The recess 17, or any other mechanical equivalent thereof, is provided for the connection of the shaft 13 to the valve or other apparatus which is to be operated by the actuator.

Figure 2:
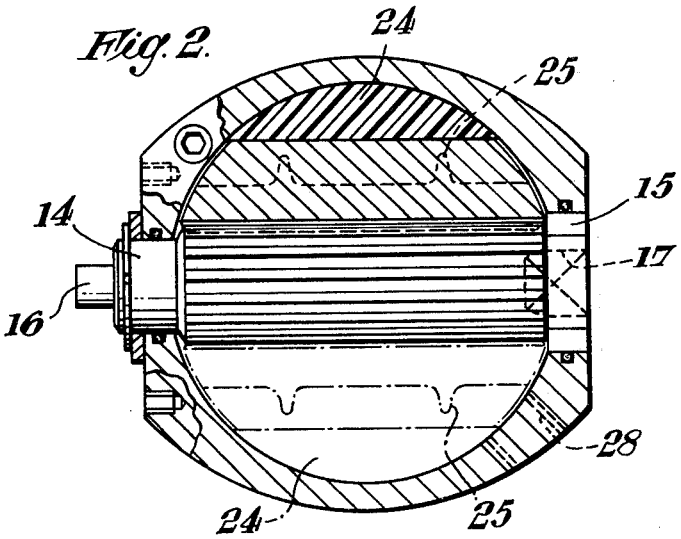
FIG. 2 represents a transverse section through the actuator illustrated in FIG. 1 on the line A—A thereon.

Although not actually illustrated in FIG. 2 of the drawings, bearings will be provided at the journals of the shaft 13 and said bearings will be positioned axially outwardly of the O-ring seals which are illustrated in FIG. 2. Besides being provided to cater for the tooth separating forces generated between the teeth 18 of the center gear and the teeth of the racks 19 when the pistons are moved towards or away from one another, the bearings referred to in the preceding sentence are necessary also to cater for any slight misalignment due to manufacturing tolerances; said bearings permit the misalignment to be made good with the result that the center gear will be equally driven by said racks.

The preferred material for the guide bearings 24 is an acetyl resin (for example DELRIN, Registered Trade Mark) which wears well, possesses good compressive stress characteristics, and has a low coefficient of friction.

Figure 3:
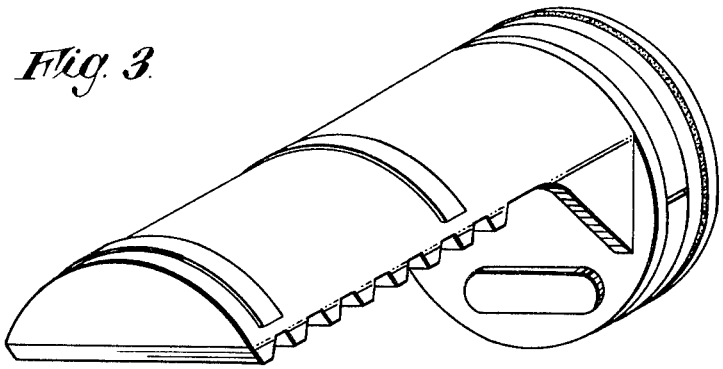
FIG. 3 is a perspective view of a cylinder having a plurality of radial bearing strips.
Figure 4:
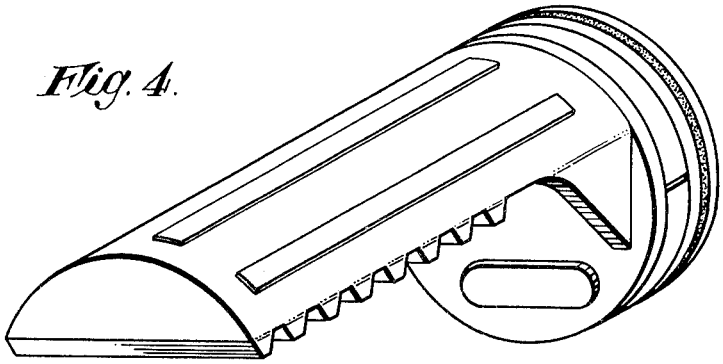
FIG. 4 is a perspective view of a cylinder having a plurality of axial bearing strips.
Figure 5:
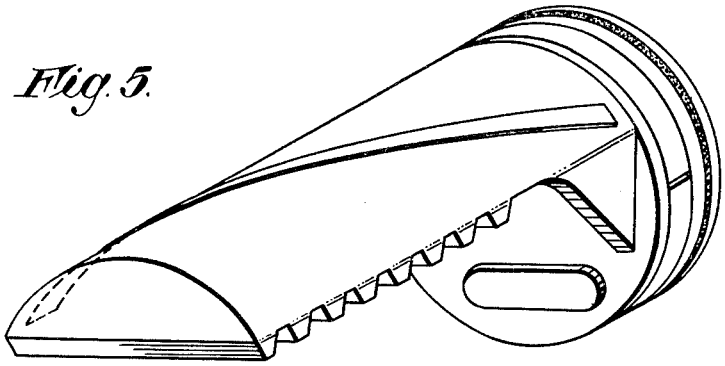
FIG. 5 is a perspective view of a piston having a helical bearing strip.
Figure 6:
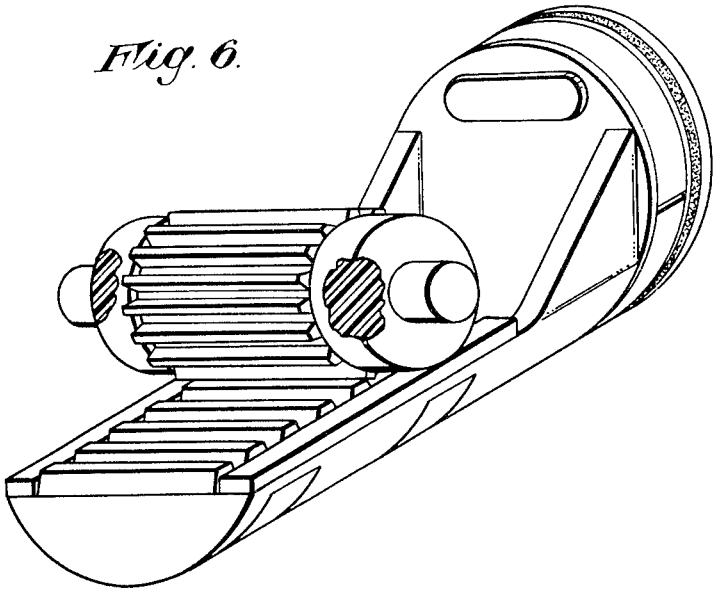
FIG. 6 is a perspective view of a piston and an output shaft showing end guide rollers which contact associate axial guide strips.
Figure 7:
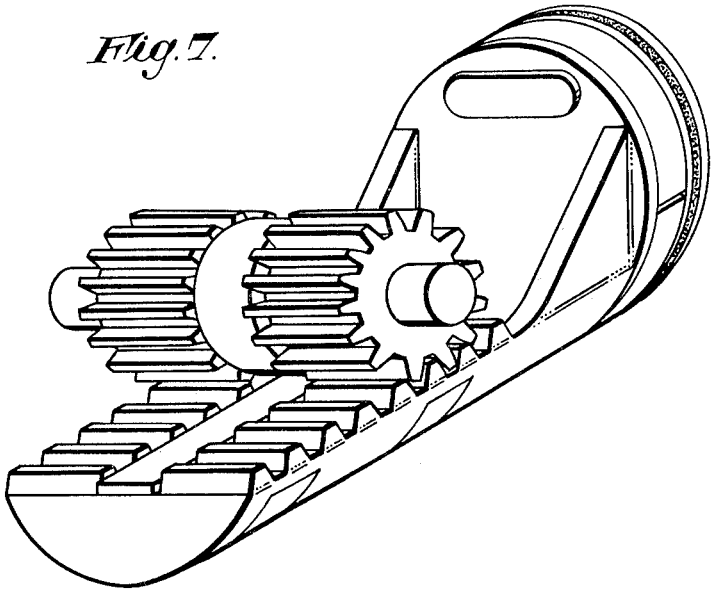
FIG. 7 is a perspective view of a cylinder and an output shaft having a central roller guide which contacts a central axial guide strip.
Figure 8:
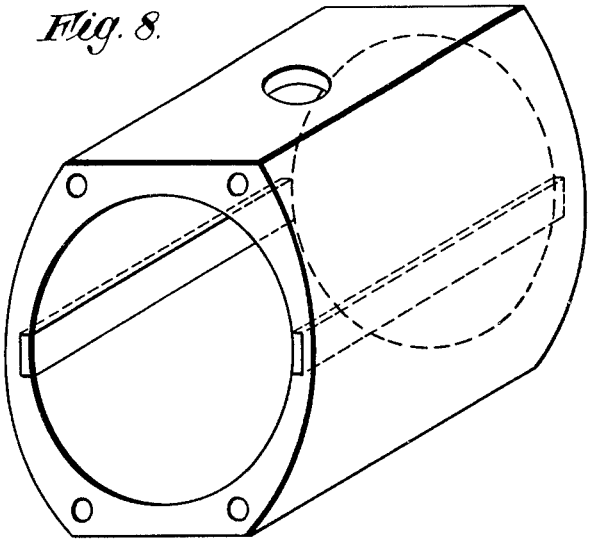
FIG. 8 is a diagramatic perspective view of the cylinder having a plurality of axial bearing strips.
Figure 9:
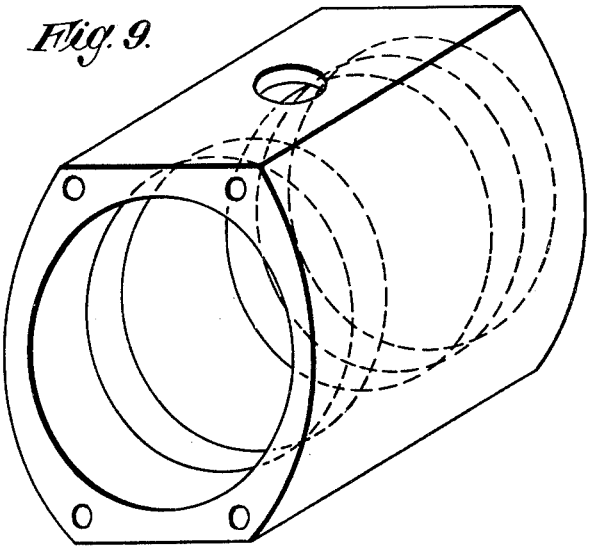
FIG. 9 is a diagramatic view of a perspective of the cylinder having a plurality of circumferential bearing strips.

The preferred embodiment of the present invention has been illustrated in the drawings and has been described above. However, the invention is not to be interpreted as limited only to such embodiment. As described earlier in this specification, other mechanical equivalents (such as strips of DELRIN carried by the cylinder instead of by the portion 23) are to be considered as falling within the scope of at least some of the appended claims. As indicated above, FIG. 3 shows a perspective view of a piston having a plurality of radial bearing strips, and FIG. 4 shows a piston having a plurality of axial bearing strips. FIG. 5 shows a piston having a helical bearing strip. FIG. 6 shows a piston and an output shaft wherein the output shaft is provided with a pair of end guide rollers which contact axial guide strips on the piston. FIG. 7 shows a piston and an output shaft wherein the output shaft is provided with a central roller guide which contacts an axial central guide strip on the piston. FIG. 8 is a diagramatic view of a cylinder having a plurality of axial bearing strips. FIG. 9 is a diagramatic view of another cylinder having a plurality of circumferential bearing strips.

What is claimed is:

1. A piston rack rotary fluid pressure actuator, comprising:

a housing including a cylinder having a central longitudinal axis;

two pistons disposed coaxially within said cylinder and arranged for linear movements substantially parallel to said central longitudinal axis of said cylinder either towards or away from one another under the influence of a difference in fluid pressure created on opposite sides of each of said pistons;

each said piston including a rack-bearing portion having a toothed rack as an integral part and said rack-bearing portion being rigidly connected to said piston;

an actuator output shaft rotatably mounted in said housing and disposed transverse to said central longitudinal axis of said cylinder at the mid-length point of said cylinder;

a pinion rigidly affixed to said actuator output shaft and disposed between said racks integral with said pistons so that teeth of the pinion engage with teeth of the racks;

at least one element having a low coefficient of friction being disposed between and in contact at all times with both said rack-bearing portion of each piston and the respective portion of the internal surface of said cylinder whereby separating forces are counteracted which are generated by movement of said pistons towards or away from one another and which tend to displace said rack-bearing portion of each of said pistons toward said respective portion of said internal surface of said cylinder;

said pinion is composed of a set of teeth which is uninterrupted axially of said actuator output shaft;

spaced annuli are carried by said actuator output shaft in the vicinities of the opposite ends of said shaft;

each of said annuli is made of a material having a low coefficient of friction;

each of said annuli is of a diameter such as will contact one of two spaced flat runways which are provided on said rack-bearing portion of each of said pistons; and said annuli contact the runways on the pistons during operation of the actuator and help to positively maintain contact between each said element and the internal surface of said cylinder and help to positively maintain correct meshing of the teeth of the racks and the pinion.

* * * * *